US011284697B2

(12) United States Patent
De Brugiere

(10) Patent No.: US 11,284,697 B2
(45) Date of Patent: Mar. 29, 2022

(54) DISPOSABLE DEFORMABLE CAPSULE

(71) Applicant: LABORATOIRES M&L, Manosque (FR)

(72) Inventor: Philippe De Brugiere, Marly le Roi (FR)

(73) Assignee: LABORATOIRES M&L, Manosque (FR)

( * ) Notice: Subject to any disclaimer, the term of this patent is extended or adjusted under 35 U.S.C. 154(b) by 0 days.

(21) Appl. No.: 16/625,072

(22) PCT Filed: Jun. 22, 2018

(86) PCT No.: PCT/FR2018/051519
§ 371 (c)(1),
(2) Date: Dec. 20, 2019

(87) PCT Pub. No.: WO2018/234717
PCT Pub. Date: Dec. 27, 2018

(65) Prior Publication Data

US 2020/0146423 A1 May 14, 2020

(30) Foreign Application Priority Data

Jun. 23, 2017 (FR) ..... 17 55751

(51) Int. Cl.
*A45D 40/24* (2006.01)
*B65D 81/32* (2006.01)
*B65D 83/00* (2006.01)

(52) U.S. Cl.
CPC ..... *A45D 40/24* (2013.01); *B65D 81/3261* (2013.01); *B65D 83/0055* (2013.01); *A45D 2200/058* (2013.01)

(58) Field of Classification Search
CPC ..... A45D 2200/058; A45D 37/00; A45D 40/0087; A45D 40/24; B65D 81/3261;
(Continued)

(56) References Cited

U.S. PATENT DOCUMENTS 4,608,043 A * 8/1986 Larkin ..... A61J 1/2093 206/219
2001/0005503 A1* 6/2001 Bara ..... A61K 8/70 424/59
2003/0019883 A1* 1/2003 De Laforcade .... B65D 81/3288 222/1
(Continued)

FOREIGN PATENT DOCUMENTS

FR 1271583 A 1/1962
FR 1459620 A 11/1966
(Continued)

OTHER PUBLICATIONS

International Search Report, dated Aug. 30, 2018, from corresponding PCT application No. PCT/FR2018/051519.
French Search Report, dated Oct. 4, 2017, from corresponding French application No. FR 1755751.

*Primary Examiner* — Vishal Pancholi
*Assistant Examiner* — Bob Zadeh
(74) *Attorney, Agent, or Firm* — Nixon & Vanderhye

(57) ABSTRACT

Disclosed is a disposable deformable capsule including: a pouch containing a predetermined amount of only one of two phases which when mixed form a ready-to-use cosmetic product, a narrowing which forms a channel leading from one side to the pouch and from the other side to outside the capsule, the pouch being flattened, one of its two faces being flat, the other of its two faces being at least partly convex and flexible to allow expelling the contents of the pouch by mechanical pressure on the pouch.

23 Claims, 8 Drawing Sheets

(58) Field of Classification Search
CPC ..... B65D 83/0055; B65D 81/3294; A61K 2800/10; A61K 2800/30; A61K 8/11; A61Q 19/00; H01L 2224/50
See application file for complete search history.

(56) References Cited

U.S. PATENT DOCUMENTS

| | | | | |
|---|---|---|---|---|
| 2006/0131189 | A1* | 6/2006 | Lee | A61C 5/66 206/229 |
| 2006/0237477 | A1* | 10/2006 | Gregg | B65D 75/5838 222/94 |
| 2006/0283761 | A1* | 12/2006 | Gherdan | B65D 81/3261 206/532 |
| 2008/0123465 | A1* | 5/2008 | Heusser | B65D 81/3261 366/130 |
| 2009/0114677 | A1* | 5/2009 | Stuart | B65D 75/5811 222/94 |
| 2012/0241465 | A1* | 9/2012 | Genosar | B05B 11/048 222/1 |
| 2016/0113377 | A1* | 4/2016 | Moussion | B65D 75/322 401/132 |

FOREIGN PATENT DOCUMENTS

| | | | | |
|---|---|---|---|---|
| FR | 2894942 | A1 * | 6/2007 | B65D 81/3294 |
| FR | 2894942 | A1 | 6/2007 | |
| JP | 2003261174 | A * | 9/2003 | B65D 75/32 |
| WO | 03/076000 | A1 | 9/2003 | |
| WO | 2004/069731 | A2 | 8/2004 | |
| WO | 2014/083279 | A1 | 6/2014 | |
| WO | 2016/102816 | A1 | 6/2016 | |

* cited by examiner

DISPOSABLE DEFORMABLE CAPSULE

FIELD OF THE INVENTION

The invention relates to the field of disposable deformable capsules.

BACKGROUND OF THE INVENTION

According to a first prior art, a number of different structures are provided for a capsule containing a ready-to-use cosmetic product, or for a capsule containing two phases separated from one another but to be mixed together to obtain a cosmetic product that is then directly ready for use.

The context for using these capsules is quite different from the context in which two capsules each containing a single phase of a cosmetic product, unusable alone independently of one another, must have their contents mixed together and homogenized before this homogenized mixture of the two phases yields the ready-to-use cosmetic product.

According to a second prior art, for example described in patent application FR 1459620, capsules of a more or less ovoid shape are provided. These capsules each contain a phase of a cosmetic product formed by the homogenized mixture of the two phases. The mixture is well homogenized, and the resulting cosmetic product is ready for immediate use.

The invention proposes improving the arrangement of the two functions of the mixing machine, which are the function of alternately expelling the contents of each capsule towards the other capsule, and then vice-versa, and the function of heating the contents of these two capsules; this improves the compactness of the machine for mixing the contents of the two capsules, while using a simple structure for each of the capsules.

Preferably, the compactness of the two capsules once assembled together will also be improved, which will also further improve the compactness of the mixing chamber of the machine for mixing the two phases respectively contained in the two capsules, these two capsules being arranged opposite one another, their flat faces facing one another.

SUMMARY OF THE INVENTION

The object of the present invention is to provide a capsule at least partially overcoming the above disadvantages.

More particularly, the invention aims to provide a capsule which is easier to use. On the one hand, the flat face of the pouch permits simple and uniform heating, and preferably even with a single heating element of simple structure and advantageously constant thickness, when two capsules are arranged opposite one another. On the other hand, the convex and flexible face of the pouch provides a simple way of expelling the entire contents of the pouch out of said pouch, simply by applying mechanical pressure, and preferably even with two mechanical elements, for example pistons, arranged opposite one another when two capsules are arranged opposite one another, each mechanical element being responsible in turn for exerting pressure on one of the capsules so as to empty its contents towards the other capsule and then vice versa.

To this end, the invention proposes a disposable deformable capsule comprising: a pouch containing a predetermined amount of only one of two phases which when mixed form a ready-to-use cosmetic product, a narrowing which forms a channel leading at one side to the pouch and at the other side to outside the capsule, characterized in that: the pouch is flattened, one of its two faces being flat, the other of its two faces being at least partly convex and flexible to allow expelling the contents of the pouch by mechanical pressure on said pouch.

Preferably, the pouch comprises two compartments separated by a frangible wall, said phase being located only in the compartment not opening into said channel, only this compartment comprising said phase being convex prior to rupture of said frangible wall. This phase will therefore be well preserved, for example during storage, because the frangible wall separating the two compartments of the pouch enable vacuum filling and sealing the phase in the pouch.

According to the invention, a pair of disposable deformable capsules is further provided, each capsule being according to the invention.

According to the invention, a pair of disposable deformable capsules is further provided, comprising: a first capsule comprising: a first pouch containing a predetermined amount of only one of two phases which when mixed form a ready-to-use cosmetic product, a first narrowing which forms a first channel leading at one side into the first pouch and at the other side to outside the first capsule, the first pouch being flattened, one of its two faces being flat, the other of its two faces being at least partly convex and flexible to allow expelling the contents of the first pouch by mechanical pressure on said pouch; a second capsule comprising: a second pouch containing a predetermined amount of only the other of the two phases which when mixed form said ready-to-use cosmetic product, a second narrowing which forms a second channel leading at one side into the second pouch and at the other side to outside the second capsule, the second pouch being flattened, one of its two faces being flat, the other of its two faces being at least partly convex and flexible so as to allow expelling the contents of the second pouch by mechanical pressure on said pouch, the first capsule and the second capsule being intended to be interconnected by the communication established between the first channel and the second channel, by their side which leads to outside their capsule.

Preferably, the first capsule and second capsule are interconnected by the communication established between the first channel and the second channel, by their side which leads to outside their capsule, and the interior of the first and second channels forms a space located between the first and second pouches and which, extending to inside the first and second pouches, is: separated, by a first frangible wall, from a compartment of the first pouch containing one of said two phases, separated, by a second frangible wall, from a compartment of the second pouch containing the other of said two phases, and empty before the first and second frangible walls are ruptured.

According to preferred embodiments, the invention comprises one or more of the following features of which one, some, or all of them may be combined, with one of the aforementioned objects of the invention.

Preferably, the end of the channel leading to outside the capsule incorporates a male or female connector part which is intended to mate with the female or male connector part of another capsule, this connector part being of molded plastic, preferably injected polymer, advantageously polypropylene or polyethylene.

The capsules are thus coupled together without needing to further increase the complexity of the structure of the capsules to be coupled together.

Preferably, the at least partly convex face of the pouch is formed by a thermoformed shell containing said phase, and the flat face of the pouch is formed by a film covering this shell, the film preferably being welded to this shell, advantageously by thermal heating.

The manufacture of the capsule is thus greatly improved, because all the shapes are on one of the faces of the capsule, while the other face of the capsule which is completely flat simply covers the first face of the capsule which is three-dimensional. In addition, the asymmetrical shape of the pouch of each capsule is achieved in a simple manner while obtaining a capsule pouch that will remain robust.

Preferably, one face of the channel is at least partly convex, and preferably is formed by a thermoformed shell, and the other face of the channel is at least partly flat, and preferably is formed by a film covering this shell, the film preferably being welded to this shell, advantageously by thermal heating.

The simplicity of the manufacture is thus improved because the film, which is flat, simply covers a shell, which is three-dimensional but which is preformed. Having a single structure, namely a shell covered by a film, makes it possible to simultaneously produce both the capsule pouch and the communication channel portion extending from this capsule pouch.

Preferably, the thermoformed shell is multilayer and advantageously comprises an inner layer of polyolefin polymer, and the film is multilayer and advantageously comprises an inner layer of polyolefin polymer.

Polyolefin polymer is a material that is particularly well-suited for welding to itself.

Preferably, the capsule comprises an empty buffer zone separated from the pouch by a frangible wall, no cosmetic component being in said buffer zone, and said channel leads at one side to the buffer zone and at the other side to outside the capsule.

Thus, firstly, good preservation of the phases of the cosmetic product is ensured before mixing, because the frangible wall separating the two compartments of the pouch allows vacuum filling and sealing the phase in the pouch, and secondly the mixing operation itself is substantially simplified, since the capsule pouch, which initially contained only one phase, can now receive the entire mixture containing the two phases to be mixed together in order to obtain the ready-to-use cosmetic product.

Preferably, said channel is of constant cross-section along most of its length, preferably its entire length.

Thus, the acceleration of the mixture as it passes through the channel combined with the accompanying drop in pressure, followed by a deceleration of the mixture with the accompanying increase in pressure, encourages shear in the mixture after this passage, and therefore improves the homogenization in this mixing of the contents of the pouches of two separate capsules.

Preferably, said channel portion of constant cross-section has a cross-section of between 0.5 and 3 $mm^2$, preferably between 1 and 2 $mm^2$.

This small value for the channel cross-section thus accelerates the mixture passing through the channel and reduces its pressure, thereby improving the shear of the mixture exiting the channel, said shear becoming more significant and thereby improving the homogenization of the mixing of the contents of the pouches of two separate capsules.

Preferably, said channel has a size or diameter which is at most 20% of the size or diameter of the pouch, preferably at most 15%, more preferably at most 12%. Preferably, said channel has a size or diameter which is at least 2% of the size or diameter of the pouch, preferably at least 4%, more preferably at least 8%.

These values for the ratios between the size of the channel and the size of the pouch ensure, firstly, a preferred maximum value for the relative narrowing threshold which makes it possible to obtain a particularly advantageous shear threshold and therefore homogenization threshold, and secondly, a preferred minimum value for the relative narrowing threshold which makes it possible to maintain an advantageously short traversal time to transfer the mixture from the pouch of one capsule to the other pouch of the other capsule.

Preferably, the thickness of the pouch is between 5% and 30% of its length, preferably between 10% and 20% of its length. Preferably, the thickness of the pouch is between 10% and 50% of its width, preferably between 20% and 40% of its width.

These size ratios facilitate deformation of the capsule pouch, without requiring the use of soft or thin material. This deformation temporarily increases the volume-to-surface ratio of the pouch, which is useful for easily accommodating the passage of the entire mixture through the channel and into this pouch.

Preferably, said narrowing which forms a channel is sufficiently narrow and sufficiently long for mechanical pressure to be able to transfer the contents of one of said pouches to the other of said pouches, creating shear in said contents exiting said narrowing which forms a channel, said shear homogenizing the mixture of said two phases, said homogenized mixture being a cosmetic product directly consumable by the end consumer.

A disposable capsule is thus provided for producing a cosmetic product directly consumable by the end consumer, for which the obtained mixture is more homogeneous.

Preferably, the channel formed by the portion of the first channel and the portion of the second channel, of constant cross-section, has a length of between 0.5 and 10 mm, preferably between 1 and 5 mm, more preferably between 2 and 4 mm.

Thus, this combined effect of acceleration and drop in pressure, encouraging shear in the mixture leaving the channel and improving its homogenization, occurs for a longer duration while passing through the channel.

Preferably, said pouches are each sufficiently large to contain all of said mixture, more preferably sufficiently large to contain one and a fourth of all of said mixture, even more preferably sufficiently large to contain one and a half of all of said mixture. Advantageously, the pouches are deformable but not expandable.

Thus, with each transfer of the mixture from one of the pouches to the other pouch, the entire mixture passes through the channel, and not just some or most, thereby reducing the number of transfers required to obtain a given level of homogenization.

Preferably, said first disposable pouch comprises a predetermined amount of an excipient phase of a cosmetic product, and said second disposable pouch comprises a predetermined amount of a phase containing active ingredients of a cosmetic product, said second pouch advantageously being sterilized. The mixing of an excipient phase and a phase containing active ingredients just before use by the end consumer and the production of a single dose for immediate use eliminates the need to add preservatives unnecessary for cosmetic effects and usually employed in conventional cosmetics to allow storing the conventional cosmetic product over time.

Preferably, said first disposable pouch comprises a predetermined amount of a fatty phase of a cosmetic product, and said second disposable pouch comprises a predetermined amount of an aqueous phase of a cosmetic product, said second pouch being advantageously sterilized. The mixing of a fatty phase and an aqueous phase just before use by the end consumer and the production of a single dose for immediate use eliminates the need to add preservatives unnecessary for cosmetic effects and usually employed in conventional cosmetics to allow storing the conventional cosmetic product over time.

The fatty phase or the excipient phase determines the type of skincare base, while the aqueous phase or phase containing active ingredients primarily constitutes the active complex.

Preferably, said fatty phase of said cosmetic product may be of different types corresponding to different preparations, and said aqueous phase of said cosmetic product may comprise different groups of active ingredients corresponding to the different skincare needs of the end consumer. The different preparations are for example a lotion or a cream. Thus the end consumer, who may be male or female, can choose the type of skincare base desired, independently of the type of active complex appropriate for his or her skin.

Other features and advantages of the invention will be apparent from the following description of a preferred embodiment of the invention, given by way of example and with reference to the appended drawings.

DETAILED DESCRIPTION OF THE INVENTION

Figure 1A:
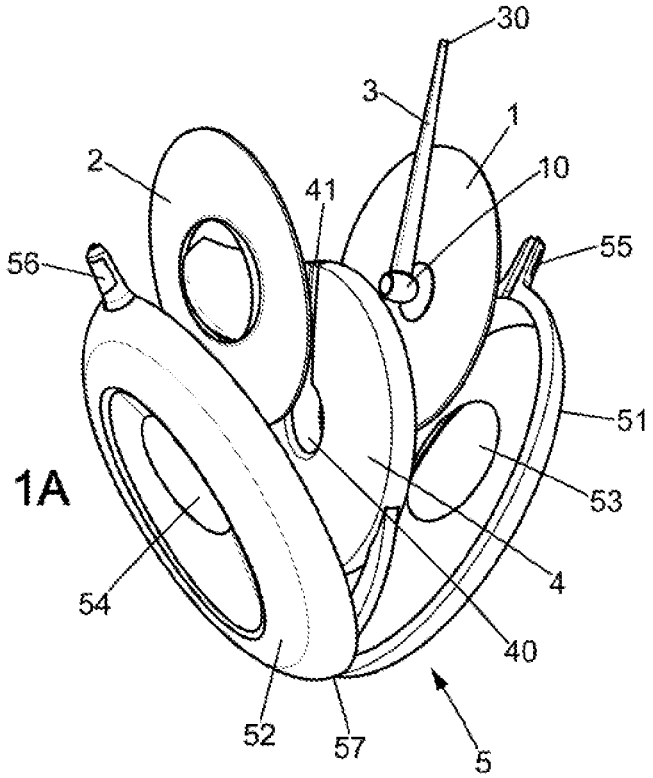
FIG. 1A schematically represents a perspective view of an exemplary shuttle associated with a pair of capsules according to one embodiment of the invention.

FIG. 1A schematically represents a perspective view of an exemplary shuttle associated with a pair of capsules according to one embodiment of the invention.

Figure 1B:
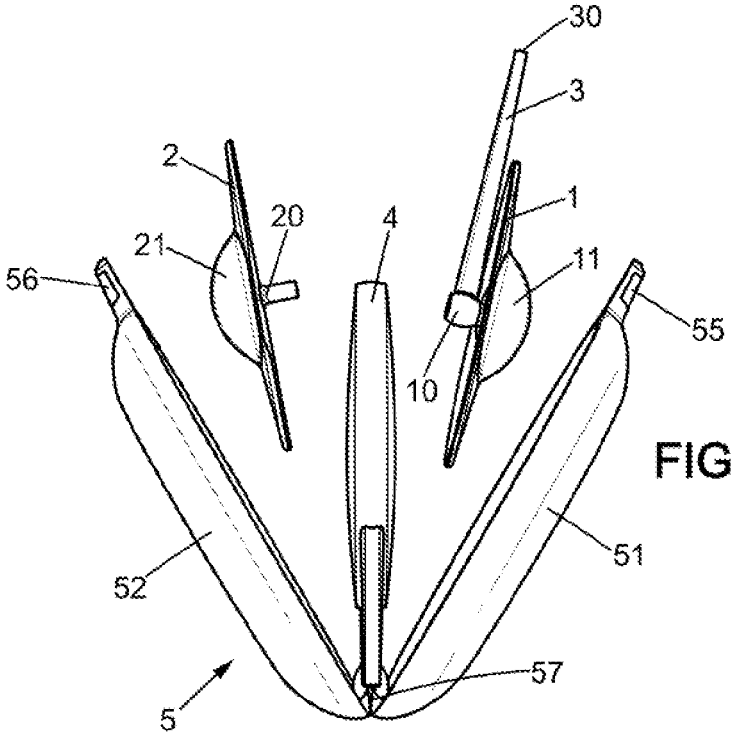
FIG. 1B schematically represents a side view of an exemplary shuttle associated with a pair of capsules according to one embodiment of the invention.

FIG. 1B schematically represents a side view of an exemplary shuttle associated with a pair of capsules according to one embodiment of the invention.

A first capsule 1 comprises a first pouch 11 filled with a first phase of a cosmetic product, a male connector 10, and an outlet passage 3 terminated by an outlet orifice 30.

A second capsule 2 comprises a second pouch 21 filled with a second phase of a cosmetic product, and a female connector 20.

Homogenized mixing of the first phase and second phase yields a cosmetic product ready for use by the user. This cosmetic product is for example a cream for the face that is completely devoid of preservatives. The first phase is for example an aqueous phase that is the active complex, while the second phase is for example a fatty phase that is the excipient.

A shuttle 5 comprises two shells 51 and 52 which rotate about a hinge 57. The first shell 51 comprises a first passage 53 at its center and a first exit guide 55 situated opposite the hinge 57. The second shell 52 comprises a second passage 54 at its center and a second outlet guide 56 situated opposite the hinge 57. The shuttle 5 also comprises a heating plate 4 which is attached at the hinge 57, which is pierced at its center by a hole 40 to be traversed by the male connector 10 fitted into the female connector 20, and which comprises a groove 41 intended to receive the outlet passage 3. In place of the passages 53 and 54, the shells 51 and 52 could simply comprise central flexible portions enabling pressure outside the shuttle 5 to be exerted on the pouches 11 and 21 of the capsules 1 and 2.

When the shuttle 5 is opened, the two shells 51 and 52 move apart from each other and from the heating plate 4, and the two capsules 1 and 2 can be introduced one on each side of the heating plate 4.

Figure 2A:
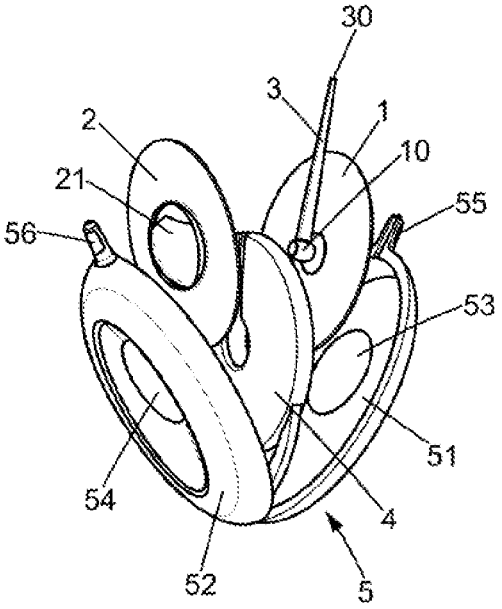
FIG. 2A schematically represents a first step of associating an exemplary shuttle with a pair of capsules according to one embodiment of the invention, which is a step of inserting the pair of capsules into the shuttle.

FIG. 2A schematically represents a first step of associating an exemplary shuttle with a pair of capsules according to one embodiment of the invention, which is a step of inserting the pair of capsules into the shuttle.

When the shuttle 5 is opened, the two shells 51 and 52 move apart from one another and from the heating plate 4, and the two capsules 1 and 2 can be introduced one on each side of the heating plate 4, in other words respectively between the first shell 51 and the heating plate 4 and between the second shell 52 and the heating plate 4. This step of inserting the pair of capsules 1 and 2 into the shuttle 5 is performed manually by the user.

Figure 2B:
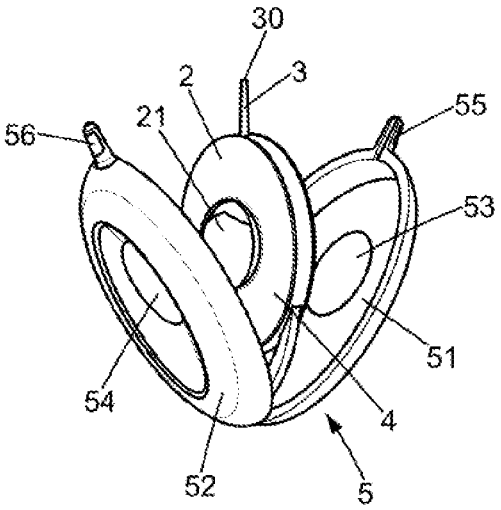
FIG. 2B schematically represents a second step of associating an exemplary shuttle with a pair of capsules according to one embodiment of the invention, which is a step of placing the pair of capsules in the shuttle.

FIG. 2B schematically represents a second step of associating an exemplary shuttle with a pair of capsules according to one embodiment of the invention, which is a step of placing the pair of capsules in the shuttle.

The capsules 1 and 2 are pressed against the heating plate 4, one on each side of the heating plate 4. The male connector 10 fits into the female connector 20, the assembly consisting of the male connector 10 and female connector 20 passing through the hole 40, the outlet passage 3 being housed in the groove 41, the outlet orifice 30 being outside the groove 41. This step of placing the pair of capsules 1 and 2 in the shuttle 5 is performed manually by the user.

Figure 2C:
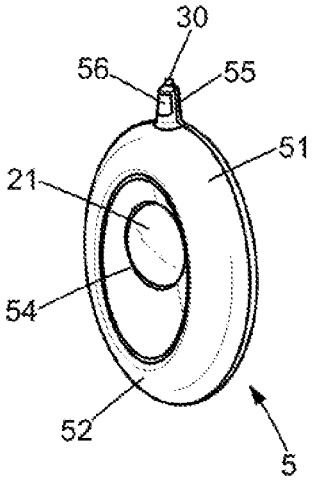
FIG. 2C schematically represents a third step of associating an exemplary shuttle with a pair of capsules according to one embodiment of the invention, which is a step of closing the shuttle containing the pair of capsules.

FIG. 2C schematically represents a third step of associating an exemplary shuttle with a pair of capsules according to one embodiment of the invention, which is a step of closing the shuttle containing the pair of capsules.

The shells 51 and 52 are brought closer to one another until they touch and close together, for example one snap-fitting into the other. When the shuttle 5 containing the pair of capsules 1 and 2 is closed, the first pouch 11 passes through the first passage 53 to protrude from the shuttle 5, the second pouch 21 passes through the second passage 54 to protrude from the shuttle 5, and the outlet passage 3 passes between the guides 55 and 56 to provide an opening to the outside via its outlet orifice 30. This step of closing the shuttle 5 containing the pair of capsules 1 and 2 is performed manually by the user.

Figure 2D:
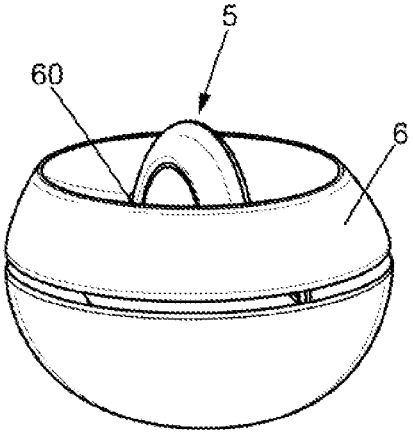
FIG. 2D schematically represents a fourth step of associating an exemplary shuttle with a pair of capsules according to one embodiment of the invention, which is a step of inserting the shuttle containing the pair of capsules into the mixer.

FIG. 2D schematically represents a fourth step of associating an exemplary shuttle with a pair of capsules according to one embodiment of the invention, which is a step of inserting the shuttle containing the pair of capsules into the mixer.

The shuttle 5 is inserted into a mixer 6 whose function is to mix together the first and second phases respectively contained in the capsules 1 and 2, homogenizing the mixture so as to form for example an emulsion which will be the final cosmetic product to be directly and immediately consumed by the user. The shuttle 5 is inserted into the mixer 6, specifically into an opening 60 of the mixer 6, the guides 55 and 56 as well as the outlet orifice 30 entering the opening 60 of the mixer 6 first so that they are housed and possibly nested in the bottom of the opening 60. The shuttle 5 is pushed to the bottom of the opening 60 so that it nests in the opening 60 and be held in place within the opening 60 during the entire mixing operation which will then take place. The guides 55 and 56 are closed one over the other and pressed against each other when they are in the bottom of the opening 60 of the mixer 6, which has the effect of clamping the outlet passage 3 upstream of the outlet orifice 30 so that no phase or cosmetic product can leave the space defined by the pair of capsules 1 and 2 and by the communication channel between these capsules 1 and 2, as long as the shuttle 5 is closed and positioned against the bottom of the opening 60 of the mixer 6. It is the closure and the pressure of the guides 55 and 56 against each other, when the shuttle 5 is closed and positioned against the bottom of the opening 60 of the mixer 6, which mechanically causes the clamping of the outlet passage 3 upstream of the outlet orifice 30. This step of inserting the shuttle 5 containing the pair of capsules 1 and 2 into the mixer 6 is performed manually by the user.

Figure 3A:
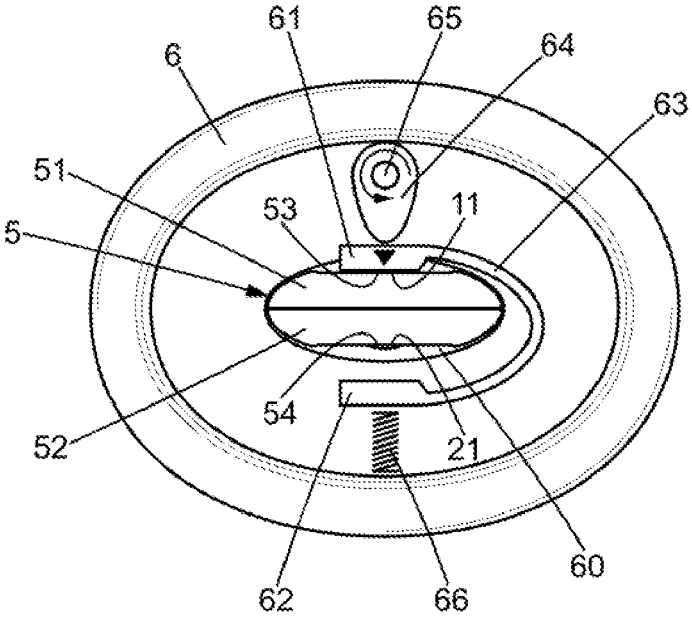
FIG. 3A schematically represents an internal top view of a first alternating phase of operation of the pressure members alternately pressing on one or the other of the capsules contained in the shuttle placed in the mixer, according to one embodiment of the invention.

FIG. 3A schematically represents an internal top view of a first alternating phase of operation of the pressure members alternately pressing on one or the other of the capsules contained in the shuttle placed in the mixer, according to one embodiment of the invention.

Figure 3B:
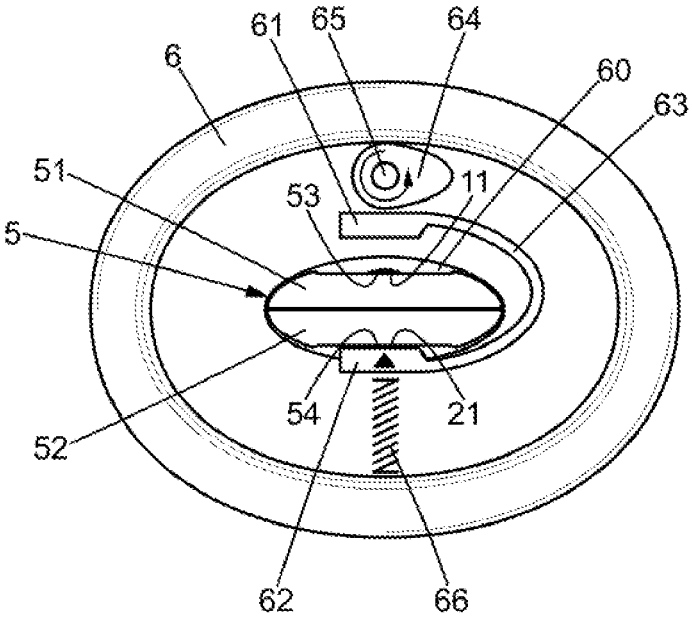
FIG. 3B schematically represents an internal top view of a second alternating phase of operation of the pressure members alternately pressing on one or the other of the capsules contained in the shuttle placed in the mixer, according to one embodiment of the invention.

FIG. 3B schematically represents an internal top view of a second alternating phase of operation of the pressure members alternately pressing on one or the other of the capsules contained in the shuttle placed in the mixer, according to one embodiment of the invention.

The mixer 6 receives the shuttle 5 into its opening 60. Opposite the first shell 51, more specifically facing the first pouch 11 protruding from the first passage 53, is a first pressure member 61, for example a piston or pressure finger, whose lateral movement (vertical and downward in FIG. 3A) indicated by a triangular arrow in FIG. 3A presses on the first pouch 11 of the first capsule 1 in order to empty it of its contents towards the second pouch 21 of the second capsule 2, through an inter-capsule communication channel not visible in FIG. 3A.

Opposite the second shell 52, more specifically facing the second pouch 21 protruding from the second passage 54, is a second pressure member 62, for example of a piston or pressure finger, whose lateral movement (vertical and upward in FIG. 3B) indicated by a triangular arrow in FIG. 3B presses on the second pouch 21 of the second capsule 2 in order to empty it of its contents towards the first pouch 11 of the first capsule 1, through an inter-capsule communication channel not visible in FIG. 3B.

The first pressure member 61 and the second pressure member 62 are integral with an arm 63. On one side of the shuttle 5, an oblong cam 64 bears against the first pressure member 61 to push it towards the first shell 51 and towards the first pouch 11. On the other side of the shuttle 5, a compressed spring 66 bears against the second pressure member 62 to push it towards the second shell 52 and the second pouch 21. The alternating lateral pressure movements of the pressure members 61 and 62 on their respective capsules 1 and 2 are caused by the rotation of the oblong cam 64 about an axis of rotation 65, in the direction of the circular arrow.

When the small dimension of the oblong cam 64 is parallel to the center plane of the shuttle 5, the oblong cam 64 presses on the first pressure member 61 which presses on the first pouch 11 to empty its contents into the second pouch 21 through an inter-capsule communication channel not visible in FIGS. 3A and 3B. The arm 63 shifts to one side of the shuttle 5, moving the second pressure member 62 away from the shuttle 5, which compresses the spring 66.

When the large dimension of the oblong cam 64 is parallel to the center plane of the shuttle 5, the spring 66 relaxes and pushes the second pressure member 62 which presses on the second pouch 21 to empty its contents into the first pouch 11 through an inter-capsule communication channel not visible in FIGS. 3A and 3B. The arm 63 shifts to the other side of the shuttle 5, moving the second pressure member 62 away from the shuttle 5 to abut against the oblong cam 64.

During a complete revolution of the oblong cam 64, the arm 63 moves back and forth in translation, the first pressure member 61 first pressing once on the first pouch 11 of the first capsule 1 to empty its contents towards the second pouch 21 of the second capsule 2, the second pressure member 62 then pressing once on the second pouch 21 of the second capsule 2 to empty its contents towards the first pouch 11 of the first capsule 1, and the spring 66 is first compressed once and then relaxes once. This cycle is repeated between 2 and 15 times, preferably between 5 and 10 times, until the mixture of the two phases is properly homogenized, for example well emulsified, so as to form a homogeneous cosmetic product, for example an emulsion, ready for direct and immediate use by the user, the user then applying for example to the facial skin the facial cream thus obtained, which is natural and fresh without preservatives, because the phases are mixed immediately prior to use.

Figure 4A:
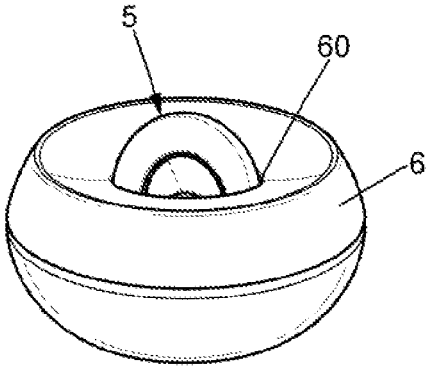
FIG. 4A schematically represents a first step of arranging the mixture of the phases respectively originally contained in the two capsules of the pair of capsules according to one embodiment of the invention, which is a step of stopping the mixing previously being carried out in the mixer.

FIG. 4A schematically represents a first step of arranging the mixture of the phases respectively originally contained in the two capsules of the pair of capsules according to one embodiment of the invention, which is a step of stopping the mixing previously being carried out in the mixer. Once the mixture of the two phases respectively from the two capsules 1 and 2 is properly homogenized, the pressure members 61 and 62 stop their movement relative to the shuttle 5.

Figure 4B:
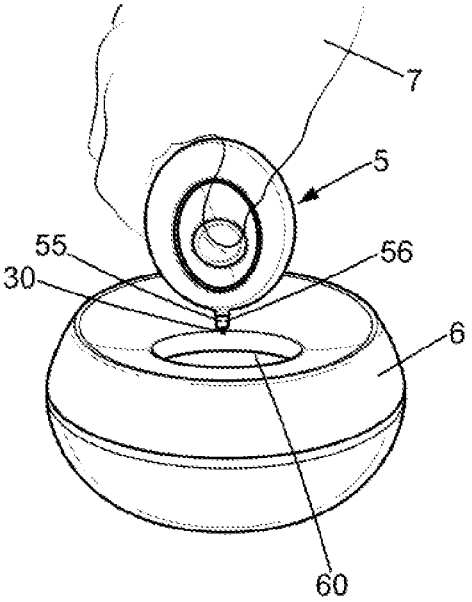
FIG. 4B schematically represents a second step of arranging the mixture of the phases respectively originally contained in the two capsules of the pair of capsules according to one embodiment of the invention, which is a step of extracting the shuttle containing the mixture, from the mixer.

FIG. 4B schematically represents a second step of arranging the mixture of the phases respectively originally contained in the two capsules of the pair of capsules according to one embodiment of the invention, which is a step of extracting the shuttle containing the mixture, from the mixture. The user's hand 7 removes the shuttle 5 from the opening 60 of the mixer 6. The removal of the shuttle 5 from the opening 60 of the mixer 6 causes the mechanical release of the clamping of the outlet orifice 30 by the guides 55 and 56 of the shells 51 and 52.

Figure 4C:
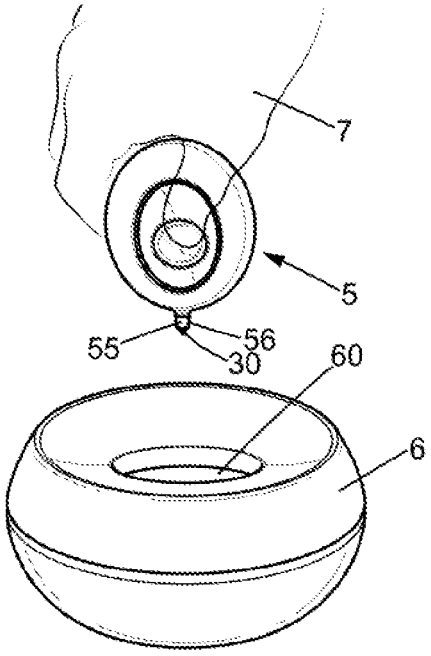
FIG. 4C schematically represents a third step of arranging the mixture of the phases respectively originally contained in the two capsules of the pair of capsules according to one embodiment of the invention, which is a step of moving the shuttle containing the mixture away from the mixer.

FIG. 4C schematically represents a third step of arranging the mixture of the phases respectively originally contained in the two capsules of the pair of capsules according to one embodiment of the invention, which is a step of moving the shuttle containing the mixture away from the mixer. The user's hand 7 moves the shuttle 5 away from the mixer 6 so that the cosmetic product contained in the shuttle 5 can be used, this cosmetic product being the homogenized mixture of the two phases respectively originally contained in the two capsules 1 and 2.

Figure 5:
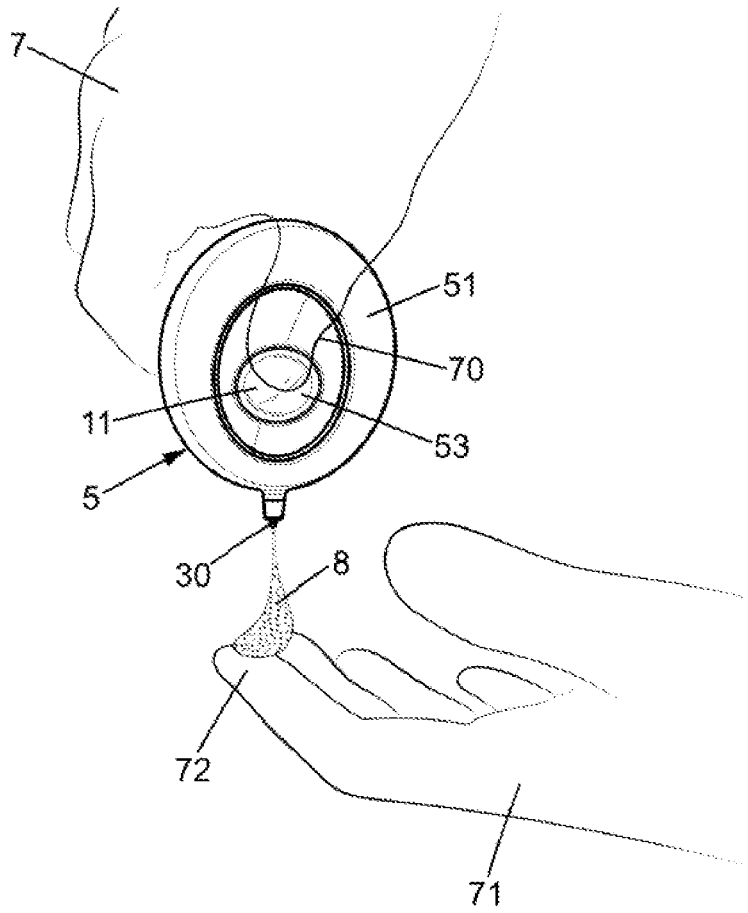
FIG. 5 schematically represents a step of using the mixture of the phases respectively originally contained in the two capsules of the pair of capsules according to one embodiment of the invention.

FIG. 5 schematically represents a step of using the mixture of the phases respectively originally contained in the two capsules of the pair of capsules according to one embodiment of the invention.

The user's hand 7, more specifically one or more fingers 70, for example the thumb, presses simultaneously on each side of the shuttle 5, at the passages 53 and 54 of the shells 51 and 52, on the pouches 11 and 12 of the capsules 1 and 2, to cause the homogenized mixture constituting the ready-to-use cosmetic product 8 to exit through the outlet orifice 30 which is no longer clamped. This ready-to-use cosmetic product 8 exits through the outlet orifice 30, and gravity causes it to fall onto the fingers 72 of the user's other hand 71 which is positioned to receive this cosmetic product 8. With this cosmetic product 8 in his or her hand 71, the user can use it directly and immediately, for example spreading the skincare cream 8 on the face with his or her hand 71.

Figure 6:
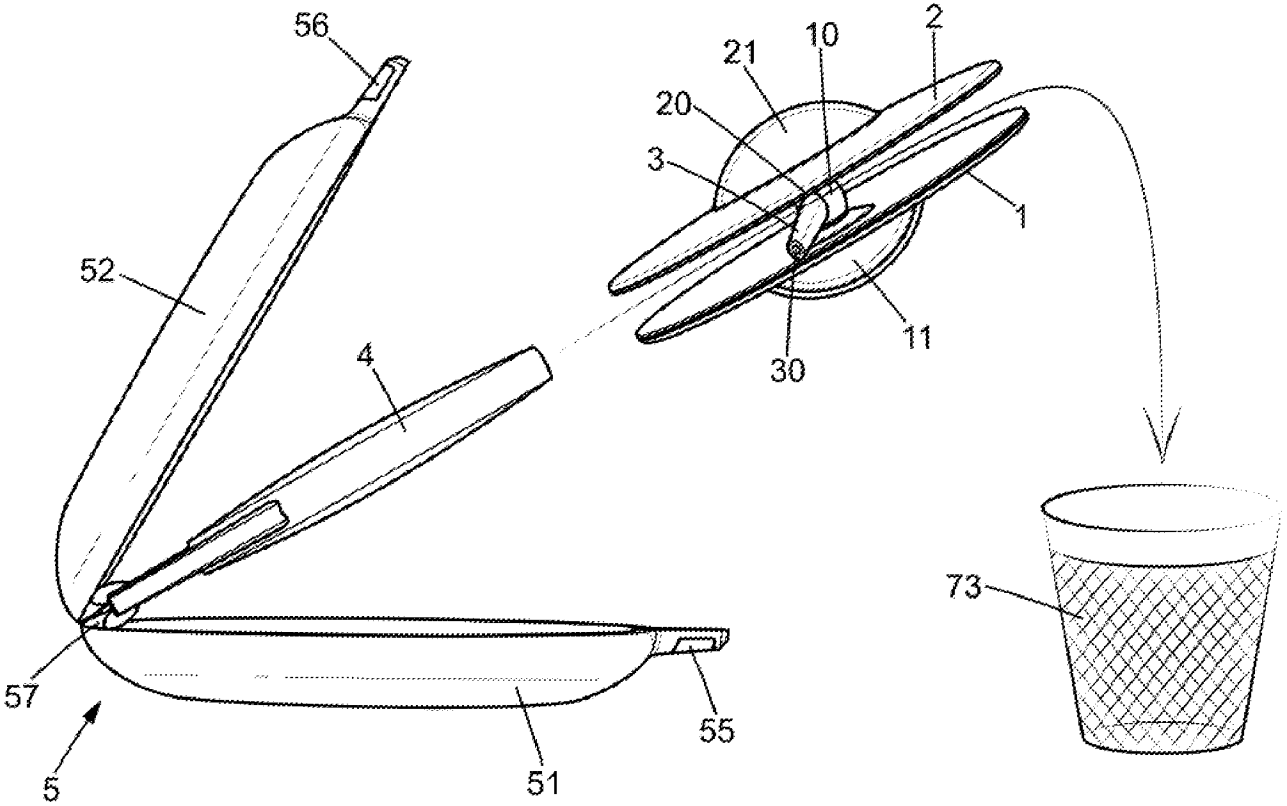
FIG. 6 schematically represents a step of removing the pair of capsules according to one embodiment of the invention, from the shuttle.

FIG. 6 schematically represents a step of removing the pair of capsules according to one embodiment of the invention, from the shuttle.

The shells 51 and 52 have been moved apart from each other. The user removes the pair of capsules 1 and 2 from the shuttle 5, after detaching the capsules 1 and 2 from the heating plate 4. The user can then discard this pair of capsules 1 and 2 in a waste receptacle 73, for example a trash can 73.

Figure 7A:
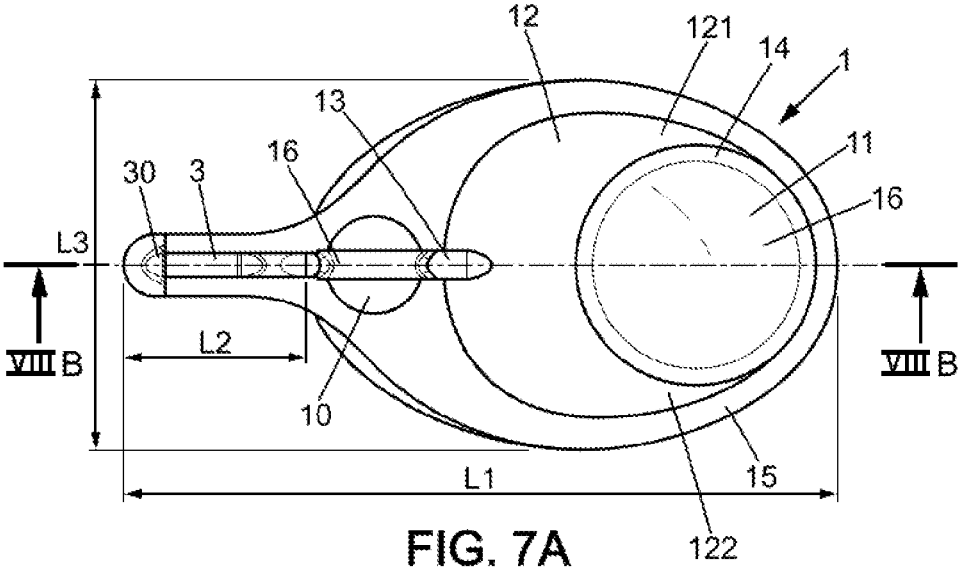
FIG. 7A represents a top view of an exemplary pair of capsules according to one embodiment of the invention, assembled together when placed in the shuttle.

FIG. 7A represents a top view of an exemplary pair of capsules according to one embodiment of the invention, assembled together when placed in the shuttle.

Figure 7B:
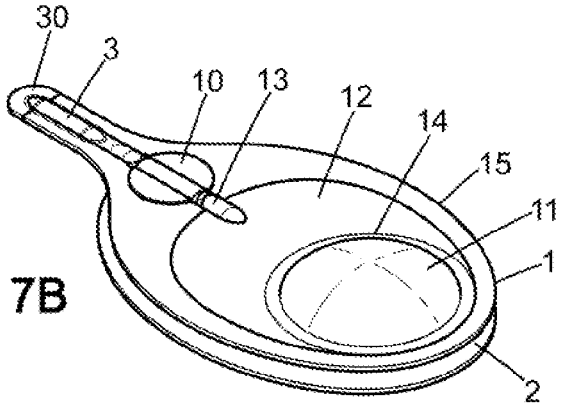
FIG. 7B represents a perspective view of an exemplary pair of capsules according to one embodiment of the invention, assembled together when placed in the shuttle.

FIG. 7B represents a perspective view of an exemplary pair of capsules according to one embodiment of the invention, assembled together when placed in the shuttle.

A first capsule 1 comprises a first pouch 11 containing a first phase intended to be mixed with a second phase from a second pouch 21 of a second capsule 2 in order to yield a homogenized mixture, for example an emulsion, forming the ready-to-use cosmetic product directly and immediately usable by the user.

The first capsule also comprises a first buffer zone 12. The first pouch 11 is separated from the first buffer zone 12 by a first weak frangible weld 14. The assembly consisting of the first pouch 11 and the first buffer zone 12 is surrounded by a first strong weld 15 significantly stronger than the first weak frangible weld 14.

When the first weak weld 14 is broken by pressure exerted on the first pouch 11, the first phase contained in the first pouch 11 will first flow into the first buffer zone 12 and then into the segment 13 of the inter-capsule communication channel which is continued by a male connector 10 in the direction of the second capsule 2 and by an outlet passage 3 in the direction of an outlet orifice 30.

All the three-dimensional contours of the first capsule 1 are formed by a thermoformed shell 16. The total length L1 of the first capsule 1 is for example 70.8 mm. The length L2 of the outlet passage 3 is for example 18.15 mm. The total width L3 of the first capsule 1 is for example 36.5 mm.

The first disposable deformable capsule 1 comprises a predetermined amount of a first phase of a cosmetic product, and also comprises a first pouch 11 containing this first phase of cosmetic product, an outlet orifice 30 leading to outside the first capsule 1, a unobstructed channel including the first buffer zone 12, the segment 13, and the outlet passage 3, and connecting the first pouch 11 to the outlet orifice 30 with a narrowing along part of its length, a first frangible wall 14 separating the first pouch 11 from this unobstructed channel, the entire first phase of cosmetic product filling the entire first pouch 11, rupture of the first frangible wall 14 resulting in at least a portion of the first phase of cosmetic product entering this unobstructed channel, no other frangible wall being located in this unobstructed channel between the first pouch 11 and the outlet orifice 30.

The first disposable deformable capsule 1 comprises a first pouch 11 containing a predetermined amount of only one of the two phases which when mixed form a ready-to-use cosmetic product, a first empty buffer zone 12 separated from the first pouch 11 by a first frangible wall 14, no cosmetic component being in the first buffer zone 12, and a channel portion including the segment 13 and the outlet passage 3 which leads at one side to the first buffer zone 12 and at the other side to outside the first capsule 1 at the outlet port 30.

Before the first frangible wall 14 is ruptured, the first empty buffer zone 12 is in a completely flattened position in which the walls of the first buffer zone 12 are arranged one against the other.

After the first frangible wall 14 is ruptured, the first pouch 11 extends into the first buffer zone 12 and thus includes it, thereby increasing the volume of the now-extended first pouch 11.

Advantageously, the first pouch 11 has a generally convex shape in the plane of the flattened first pouch 11 which is also the plane of FIG. 7A, and the first buffer zone 12 has a generally concave shape in the plane of the flattened first pouch 11, complementary to the generally convex shape of the first pouch 11. The assembly consisting of the first pouch 11 and the first buffer zone 12 has a generally convex shape in the plane of the flattened first pouch 11. The first pouch 11 has a generally circular shape in the plane of the flattened first pouch 11, and the first buffer zone 12 has a general U-shape in the plane of the first pouch 11, with arms 121 and 122 that are thinner towards their ends.

Figure 7C:
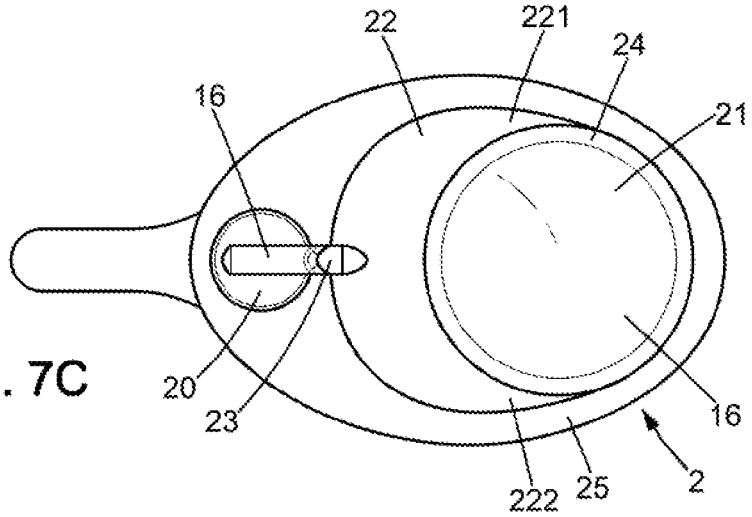
FIG. 7C represents a view from below of an exemplary pair of capsules according to one embodiment of the invention, assembled together when placed in the shuttle.

FIG. 7C represents a view from below of an exemplary pair of capsules according to one embodiment of the invention, assembled together when placed in the shuttle.

A second capsule 2 is similar to the first capsule 1. The second capsule 2 comprises a second pouch 21 containing a second phase intended to be mixed with the first phase from the first pouch 11 of the first capsule 1 in order to yield the homogenized mixture, for example an emulsion, forming the ready-to-use cosmetic product directly and immediately usable by the user.

The second capsule also comprises a second buffer zone 22. The second pouch 21 is separated from the second buffer zone 22 by a second weak frangible weld 24. The assembly consisting of the second pouch 21 and the second buffer zone 22 is surrounded by a second strong weld 25 significantly stronger than the second weak frangible weld 24.

When the second weak weld 24 is ruptured by pressure exerted on the second pouch 21, the second phase contained in the second pouch 21 will first flow into the second buffer zone 22 and then into the segment 23 of the inter-capsule communication channel which is continued by a female connector 20 in the direction of the first capsule 1.

All the three-dimensional contours of the second capsule 2 are formed by a thermoformed shell 16. The second buffer zone 22 has, in the plane of the flattened second pouch 21, a general U-shape with arms 221 and 222 that are thinner towards their ends.

Figure 8A:
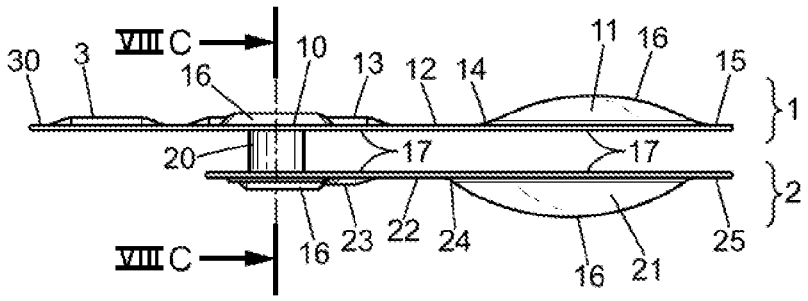
FIG. 8A represents a side view of an exemplary pair of capsules according to one embodiment of the invention, assembled together when placed in the shuttle.

FIG. 8A represents a side view of an exemplary pair of capsules according to one embodiment of the invention, assembled together when placed in the shuttle.

The thermoformed shell 16 forms the three-dimensional portions of the capsules 1 and 2. A flat film 17 covers the thermoformed shell 16, both for the first capsule 1 and the second capsule 2. The inter-capsule communication channel comprises a first right-angle bend formed by segment 13 and the male connector 10 fitted into the female connector 20, as well as a second right-angle bend formed by the male connector 10 fitted into the female connector 20 and segment 23. Flow of the mixture between the pouches 11 and 21 follows a path forming the three sides of a rectangle, the first long side comprising the first pouch 11, the first buffer zone 12, and segment 13, the second long side comprising the second pouch 21, the second buffer zone 22, and segment 23, the short side joining said two long sides and comprising the male connector 10 fitted into the female connector 20.

The pair of capsules 1 and 2 assembled together respectively comprise two different phases to be mixed in order to obtain a personalized cosmetic product, and comprise two pouches 11 and 21 respectively containing the two different phases and respectively included in the two capsules 1 and 2 and interconnected by a communication channel comprising at least one portion of narrow cross-section relative to the two pouches 11 and 21, this narrow portion of the communication channel comprising two right-angle bends, the first bend comprising channel portions 13 and 10 at right angles to each other, the second bend comprising channel portions 23 and 10 at right angles to each other. These two right-angle bends are arranged such that at least part of the narrow portion of the communication channel comprising the two right-angle bends forms the three sides of a rectangle.

Each disposable deformable capsule 1 or 2 comprises an extended pouch 11 and 12 (or 21 and 22) containing a predetermined amount of only one of the two phases which when mixed form a ready-to-use cosmetic product, a narrowing which forms a channel leading at one side into the extended pouch 11 and 12 (or 21 and 22) and at the other side to outside the capsule 1 or 2. Each extended pouch 11 and 12 (or 21 and 22) is flattened, one of its two faces being flat, the other of its two faces being at least partly convex and flexible to allow expelling the contents of the extended pouch 11 and 12 (or 21 and 22) by mechanical pressure on said pouch.

Each extended pouch 11 and 12 (or 21 and 22) comprises two compartments 11 and 12 (or 21 and 22) separated by a frangible wall 14 or 24, the actual pouch 11 or 21, and the adjoining buffer zone 12 or 22 into which the actual pouch 11 or 21 will be able to extend after rupture of the frangible wall 14 or 24. As the phase is only located in the compartment 11 or 21 not opening into this channel 13 or 23, only this compartment 11 or 21 comprising the phase is convex before rupture of the frangible wall 14 or 24. This phase will therefore be well preserved, for example during storage, because the frangible wall 14 or 24 separating the two compartments 11 and 12 (or 21 and 22) of the extended pouch 11 and 12 (or 21 and 22) allows vacuum filling and sealing the phase in the corresponding pouch 11 and 12 (or 21 and 22).

Figure 8B:
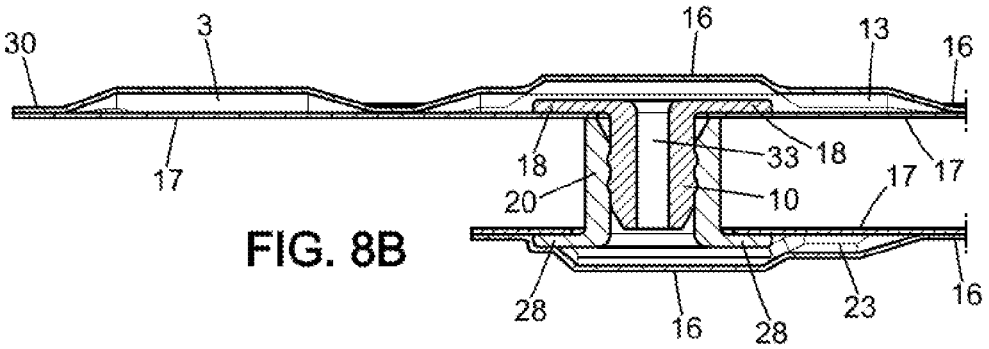
FIG. 8B shows an enlargement of a partial sectional view along axis AA, of an exemplary pair of capsules of FIG. 7A.

FIG. 8B shows an enlargement of a partial sectional view along axis AA, of an exemplary pair of capsules of FIG. 7A.

The male connector 10 fits into the female connector 20. The male connector 10 and the female connector 20 are made of rigid plastic.

On the side of the first capsule 1, the male connector 10 has a flange 18 located at its base in a plane perpendicular to the axis of the male connector 10 fitted into the female connector 20. Inside the male connector 10, the narrow channel portion 33 establishes the fluidic connection between the channel segment 13 also of narrow cross-section that is part of the first capsule 1 and the channel segment 23 also of narrow cross-section that is part of the second capsule 2. This flange 18 increases the sturdiness of the first right-angle bend of the inter-capsule communication channel.

On the side of the second capsule 2, the female connector 20 has a flange 28 located at its base in a plane perpendicular to the axis of the male connector 10 fitted into the female connector 20. Inside the male connector 10, the narrow channel portion 33 establishes the fluid connection between the channel segment 13 also of narrow cross-section that is part of the first capsule 1 and the channel section 23 also of narrow cross-section that is part of the second capsule 2. This flange 28 increases the sturdiness of the second right-angle bend of the inter-capsule communication channel.

Figure 8C:
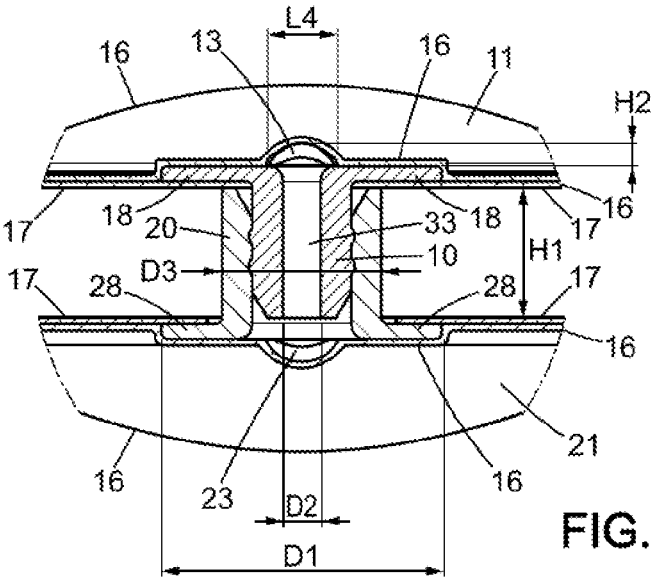
FIG. 8C shows an enlargement of a partial sectional view along axis BB, of an exemplary pair of capsules of FIG. 8A.

FIG. 8C shows an enlargement of a partial sectional view along axis BB, of an exemplary pair of capsules of FIG. 8A.

Channel segment 13 of narrow cross-section, narrow channel portion 33, and channel segment 23 of narrow cross-section all have the same value for the narrow cross-section.

The width L4 of segment 13 and segment 23 is for example 2.31 mm. The outside diameter D1 of the flanges 18 and 28 is for example 9.30 mm. The inside diameter D2 of the narrow channel portion 33 is for example 1.3 mm. The outside diameter D3 of the female connector 20 is for example 5.30 mm. The height H1 of the male connector 10 and the female connector 20 is for example 4.30 mm. The height H2 of segment 13 and segment 23 is for example 0.75 mm.

Of course, the invention is not limited to the examples and embodiment described and shown, but is suitable for many variants accessible to those skilled in the art.

The invention claimed is:

1. A disposable deformable capsule comprising:

a pouch (11, 21) containing a predetermined amount of only one of two phases which when mixed form a ready-to-use cosmetic product, a narrowing which forms a channel (13, 23) leading at one side to the pouch (11, 12 and 21, 22) and at the other side to outside the capsule (1, 2), wherein, with the pouch (11, 12 and 21, 22) being flattened, one (17) of two faces of the pouch is flat, and the other (16) of two faces of the pouch is at least partly convex and flexible to allow expelling contents of the pouch (11, 12 and 21, 22) by application of mechanical pressure on said pouch, wherein the end (30) of the channel (3) leading to outside the capsule (1, 2) incorporates a male (10) or female (20) connector part which is intended to mate with the female (20) or male (10) connector part of another capsule (1, 2), said connector part (10, 20) being of molded plastic.

2. The disposable deformable capsule according to claim 1, wherein the pouch (11, 12 and 21, 22) comprises two compartments (11, 12 and 21, 22) separated by a frangible wall (14, 24), said phase being located only in the compartment (11, 21) not opening into said channel (13, 23), only this compartment (11, 21) comprising said phase being convex prior to rupture of said frangible wall (14, 24).

3. The disposable deformable capsule according to claim 1, wherein the at least partly convex face (16) of the pouch (11, 12 and 21, 22) is formed by a thermoformed shell (16) containing said phase, and the flat face (17) of the pouch (11, 12 and 21, 22) is formed by a film (17) covering this shell (16).

4. The disposable deformable capsule according to claim 3, wherein one face (16) of the channel (3, 13, 23, 33) is at least partly convex, and the other face (17) of the channel (3, 13, 23, 33) is at least partly flat.

5. The disposable deformable capsule according to claim 4, wherein the thermoformed shell (16) is multilayer and comprises an inner layer of polyolefin polymer, and the film (17) is multilayer and comprises an inner layer of polyolefin polymer.

6. The disposable deformable capsule according to claim 1, wherein the capsule (1, 2) comprises an empty buffer zone (12, 22) separated from the pouch (11, 12 and 21, 22) by a frangible wall (14, 24), no cosmetic component being in said buffer zone (12, 22), and said channel (3, 13, 23, 33) leads at one side to the buffer zone (12, 22); 22) and at the other side to outside the capsule (1, 2).

7. The disposable deformable capsule according to claim 1, wherein said channel (13, 23, 33) is of constant cross-section along most of a length of the channel.

8. The disposable deformable capsule according to claim 7, wherein said channel portion (13, 23, 33) of constant cross-section has a cross-section of between 0.5 and 3 $mm^2$.

9. The disposable deformable capsule according to claim 1, wherein said channel (13, 23, 33) has a size or diameter which is at most 20% of the size or diameter of the pouch (11, 12 and 21, 22).

10. The disposable deformable capsule according to claim 9, wherein said channel (13, 23, 33) has a size or diameter which is at least 2% of the size or diameter of the pouch (11, 12 and 21, 22).

11. The disposable deformable capsule according to claim 1, wherein thickness of the pouch (11, 12 and 21, 22) is between 5% and 30% of a length of the pouch.

12. The disposable deformable capsule according to claim 1, wherein thickness of the pouch (11, 12 and 21, 22) is between 10% and 50% of a width of the pouch.

13. A pair of disposable deformable capsules, each capsule (1, 2) being according to claim 1.

14. The disposable deformable capsule according to claim 1, wherein, the capsule (1) incorporates the male (10) connector which is intended to mate with the female (20) connector of the another capsule (2), said male connector (10) being of molded plastic, and said capsule (1) incorporating a predetermined amount of only one of two phases which when mixed form a ready-to-use cosmetic product, but not incorporating the other of the two phases also needed to form said ready-to-use cosmetic product.

15. The disposable deformable capsule according to claim 1, wherein, the capsule (2) incorporates the female (20) connector which is intended to mate with the male (10) connector of the another capsule (1), said female connector (20) being of molded plastic, and said capsule (2) incorporating a predetermined amount of only one of two phases which when mixed form a ready-to-use cosmetic product, but not incorporating the other of the two phases also needed to form said ready-to-use cosmetic product.

16. A pair of disposable deformable capsules comprising:

a first capsule (1) comprising:

a first pouch (11, 12) containing a predetermined amount of only one of two phases which when mixed form a ready-to-use cosmetic product, a first narrowing which forms a first channel (13) leading at one side to the first pouch (11, 12) and at the other side to outside the first capsule (1), with the first pouch (11, 12) being flattened, one (17) of two faces of the first pouch is flat, and the other (16) of two faces of the first pouch is at least partly convex and flexible to allow expelling contents of the first pouch (11, 12) by application of mechanical pressure on said pouch, a second capsule (2) comprising:

a second pouch (21, 22) containing a predetermined amount of only the other of the two phases which when mixed form said ready-to-use cosmetic product, a second narrowing which forms a second channel (23) leading at one side to the second pouch (21, 22) and at the other side to outside the second capsule (2), with the second pouch (21, 22) being flattened, one (17) of two faces of the second pouch is flat, and the other (16) of two faces of the second pouch is at least partly convex and flexible to allow expelling contents of the second pouch (2) by application of mechanical pressure on said pouch, the first capsule (1) and the second capsule (2) being interconnectable by a communication established between the first channel (13) and the second channel (23), by their side which leads to outside their capsule (1, 2), wherein:

the first capsule (1) and the second capsule (2) are interconnected by the communication established between the first channel (13) and the second channel (23), by their side which leads to outside their capsule (1, 2), an interior of the first (13) and second channels (23) forms a space located between the first (11, 12) and second (21, 22) pouches and which, extending to inside the first (11, 12) and second (21, 22) pouches, is:

separated, by a first frangible wall (14), from a compartment (11) of the first pouch (11, 12) containing one of said two phases, separated, by a second frangible wall (24), from a compartment (21) of the second pouch (21, 22) containing the other of said two phases, and empty before the first (14) and second (24) frangible walls are ruptured.

17. The pair of disposable deformable capsules according to claim 16, wherein the channel (13, 23, 33) formed by a portion of constant cross-section of the first channel (13, 33) and a portion of constant cross-section of the second channel (23, 33) has a length of between 0.5 and 10 mm.

18. The pair of disposable deformable capsules according to claim 16, wherein said pouches (11, 12 and 21, 22) are sized to contain all of said contents forming said ready-to-use cosmetic product.

19. The pair of disposable deformable capsules according to claim 16, wherein said first disposable pouch (11, 12) comprises a predetermined amount of an excipient phase of a cosmetic product, and said second disposable pouch (21, 22) comprises a predetermined amount of a phase containing active ingredients of a cosmetic product, said second pouch (21, 22) being sterilized.

20. The pair of disposable deformable capsules according to claim 16, wherein said first disposable pouch (11, 12) comprises a predetermined amount of a fatty phase of a cosmetic product, and said second disposable pouch (21, 22) comprises a predetermined amount of an aqueous phase of a cosmetic product, said second pouch (21, 22) being sterilized.

21. A pair of disposable deformable capsules comprising:

a first capsule (1) comprising:

a first pouch (11, 12) containing a predetermined amount of only one of two phases which when mixed form a ready-to-use cosmetic product, a first narrowing which forms a first channel (13) leading at one side to the first pouch (11, 12) and at the other side to outside the first capsule (1), with the first pouch (11, 12) being flattened, one (17) of two faces of the first pouch is flat, and the other (16) of two faces of the first pouch is at least partly convex and flexible to allow expelling contents of the first pouch (11, 12) by application of mechanical pressure on said pouch, a second capsule (2) comprising:

a second pouch (21, 22) containing a predetermined amount of only the other of the two phases which when mixed form said ready-to-use cosmetic product, a second narrowing which forms a second channel (23) leading at one side to the second pouch (21, 22) and at the other side to outside the second capsule (2), with the second pouch (21, 22) being flattened, one (17) of two faces of the second pouch is flat, and the other (16) of two faces of the second pouch is at least partly convex and flexible to allow expelling contents of the second pouch (2) by application of mechanical pressure on said pouch, the first capsule (1) and the second capsule (2) being interconnectable by a communication established between the first channel (13) and the second channel (23), by their side which leads to outside their capsule (1, 2), wherein, said first and second channels have a first width and a first length for an application of mechanical pressure to be able to transfer contents of one of said pouches (11, 12 and 21, 22) to the other of said pouches (11, 12 and 21, 22), creating shear in said contents exiting said first and second narrowings, said shear homogenizing the mixture of said two phases, said homogenized mixture being a cosmetic product directly consumable by an end consumer.

22. A pair of disposable deformable capsules comprising:

a first capsule (1) comprising:

a first pouch (11, 12) containing a predetermined amount of only one of two phases which when mixed form a ready-to-use cosmetic product, a first narrowing which forms a first channel (13) leading at one side to the first pouch (11, 12) and at the other side to outside the first capsule (1), with the first pouch (11, 12) being flattened, one (17) of two faces of the first pouch is flat, and the other (16) of two faces of the first pouch is at least partly convex and flexible to allow expelling contents of the first pouch (11, 12) by application of mechanical pressure on said pouch, a second capsule (2) comprising:

a second pouch (21, 22) containing a predetermined amount of only the other of the two phases which when mixed form said ready-to-use cosmetic product, a second narrowing which forms a second channel (23) leading at one side to the second pouch (21, 22) and at the other side to outside the second capsule (2), with the second pouch (21, 22) being flattened, one (17) of two faces of the second pouch is flat, and the other (16) of two faces of the second pouch is at least partly convex and flexible to allow expelling the contents of the second pouch (2) by application of mechanical pressure on said pouch, the first capsule (1) and the second capsule (2) being interconnectable by a communication established between the first channel (13) and the second channel (23), by their side which leads to outside their capsule (1, 2), wherein, said first capsule (1) incorporates a male (10) connector which mates with a female (20) connector of said second capsule (2), said male connector (10) being of molded plastic, said first capsule (1) incorporating a predetermined amount of only one of two phases which when mixed form a ready-to-use cosmetic product, but not incorporating the other of the two phases also needed to form said ready-to-use cosmetic product, said second capsule (2) incorporates a female (20) connector which mates with a male (10) connector of said first capsule (1), said female connector (20) being of molded plastic, and said second capsule (2) incorporating a predetermined amount of only the other of two phases which when mixed form a ready-to-use cosmetic product, but not incorporating the one of the two phases also needed to form said ready-to-use cosmetic product.

23. A disposable deformable capsule comprising:

a pouch (11, 21) containing a predetermined amount of only one of two phases which when mixed form a ready-to-use cosmetic product, a narrowing which forms a channel (13, 23) leading at one side to the pouch (11, 12 and 21, 22) and at the other side to outside the capsule (1, 2), wherein, with the pouch (11, 12 and 21, 22) being flattened, one (17) of two faces of the pouch is flat, and the other (16) of two faces of the pouch is at least partly convex and flexible to allow expelling contents of the pouch (11, 12 and 21, 22) by application of mechanical pressure on said pouch, wherein, an interior of said channel forms a space located between the pouch (11, 12) and the channel (13) side leading to outside said capsule (1) and which, extending to inside the pouch, is:

separated, by a first frangible wall (14), from a compartment (11) of the pouch (11, 12) containing one of said two phases, and empty before the first (14) frangible wall is ruptured.

* * * * *